US005172716A

United States Patent [19]

Paptzun

[11] Patent Number: 5,172,716

[45] Date of Patent: Dec. 22, 1992

[54] RECIRCULATION VALVE

[75] Inventor: George J. Paptzun, North Wales, Pa.

[73] Assignee: Keystone International Holdings Corp., Wilmington, Del.

[21] Appl. No.: 723,959

[22] Filed: Jul. 1, 1991

[51] Int. Cl.[5] ..... G05D 11/00

[52] U.S. Cl. ..... 137/117; 137/494; 137/543.23; 251/332; 251/333

[58] Field of Search ..... 251/333, 332, 118; 137/543.23, 494, 117, 540

[56] References Cited

U.S. PATENT DOCUMENTS

| | | | |
|---|---|---|---|
| 2,163,472 | 6/1939 | Shimer | 137/543.23 |
| 3,180,360 | 4/1965 | Pavlin | 251/118 |
| 3,191,617 | 6/1965 | Maddox | 251/332 |
| 3,409,039 | 11/1968 | Griffin | 251/333 |
| 3,702,141 | 11/1972 | Wetterhorn | 137/543.23 |
| 4,648,421 | 3/1987 | Chant et al. | 137/494 |
| 4,922,957 | 3/1990 | Johnson | 137/543.23 |
| 4,941,502 | 7/1990 | Loos et al. | 137/117 |
| 4,967,783 | 11/1990 | Loos | 137/117 |
| 5,004,009 | 4/1991 | Bunce | 137/494 |

*Primary Examiner*—A. Michael Chambers
*Attorney, Agent, or Firm*—Ferrill, Logan, Johns & Blasko

[57] ABSTRACT

A recirculation valve for cooling a centrifugal pump. The invention comprises a valve casing having a first chamber for connection to a centrifugal pump and a second chamber for connection to a fluid outlet, a recirculation port for redirecting fluid from the first chamber to the centrifugal pump. Between the first and second chambers is a check valve means for permitting fluid flow from the first to the second chamber. Connected to the check valve means is a hollow cylindrical valve stem permitting flow from the first chamber to the second chamber. The check valve means is comprised of a circular disc which opens when the fluid pressure in the first chamber exceeds the fluid pressure in the second chamber and closes when the fluid pressure in the second chamber approaches that in the first and intermediate chambers. A two angle control surface between the check valve disc and the valve casing controls the position of the check valve relative to the flow of fluid past the valve. A recirculation valve means caused by the hollow cylindrical tube controls the amount of fluid flowing from the first chamber to the recirculation port. When the recirculation valve means is open, flow through the recirculation port is impeded. When the valve means is closed, recirculation flow is permitted.

21 Claims, 2 Drawing Sheets

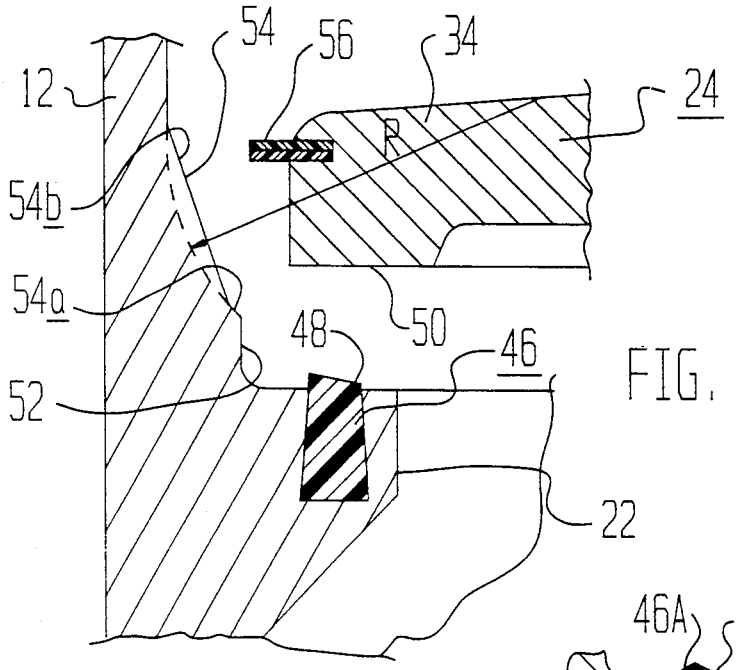
FIG. 2
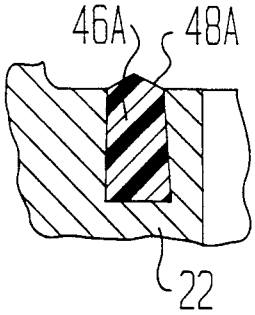
FIG. 2A
FIG. 3
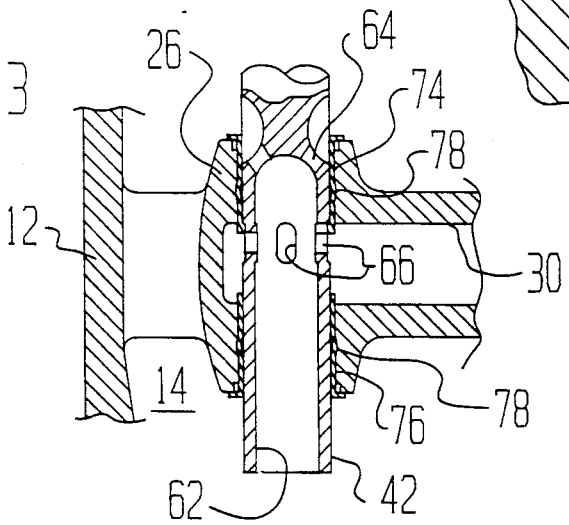

RECIRCULATION VALVE

BACKGROUND OF THE INVENTION

1. Field of the Invention

The present invention is directed to a recirculation valve for recirculating fluid back to a centrifugal pump in order to prevent damage to the pump during intervals when there is minimum demand for the pumped fluid downstream of the valve. More particularly, the present invention is directed to a recirculation valve having a two angle control surface between the check valve disc and the valve casing in order to provide a more linear relation between the position of the check valve disc and the amount of flow. The valve also allows the snap-in of different size spiral rings onto the check valve disc to change the Cv of the valve and the use of similar rings to change the Cv of the recirculation flow. The second angle provides clearance for the snap-on ring while maintaining linear characteristics for the both high main flow applications (no ring) and low flow applications (with ring).

2. Description of the Prior Art

Centrifugal pumps are used in a variety of applications. It is often desirable to recirculate fluid back to a centrifugal pump during intervals of low demand by an outlet device to prevent the pump from overheating. Overheating is caused by the exchange of heat between the running pump and stationary fluid present within the pump. Pump overheating lowers the vapor pressure, resulting in fluid cavitation which can destroy the pump housing and impeller.

Recirculation valves are frequently used in centrifugal pumps to control overheating. One commonly used recirculation valve is a modulating flow control valve disclosed in U.S. Pat. No. 4,095,611. The valve disclosed in U.S. Pat. No. 4,095,611 has a circular disc-shaped check valve member interposed within a two-piece valve casing. During periods of normal downstream fluid demand, a pressure differential across the valve causes it to open and permit flow while simultaneously blocking a fluid recirculation passageway. Conversely, during intervals of minimal downstream fluid demand, the disc-shaped check valve member returns to a closed position, thereby opening the fluid recirculation passageway and permitting fluid to recirculate back to the pump.

Another recirculation valve, disclosed in U.S. Pat. No. 4,243,064, has a circular main valve disc and bypass valve disc axially displaced at both ends of a connecting valve stem. During periods of normal fluid flow, the connecting valve stem moves to an open position causing fluid to flow out both the main outlet and the bypass outlet. When fluid flow is minimal, the bypass valve disc is superimposed over an annular seat which causes fluid to be redirected from the main outlet to the bypass outlet and recirculated through the centrifugal pump.

A problem encountered with the use of such recirculation valves is that the relation between the movement of the check valve means and the amount of recirculation flow does not always follow a linear relationship. Such a linear relationship allows more precise control of the amount of recirculation.

It is an object of the present invention to provide a recirculation valve having a two angle control surface between the check valve disc and the valve casing in order to provide a linear relationship between the open position of the check valve disc and the flow of fluid being recirculated. The main advantage of a dual angle is to maintain good linearity with and without the ring. It is more economical to provide a single body design. The dual angle allows the use of an inexpensive ring to change the main flow capacity and maintain good linearity.

It is a further object of the present invention to provide a recirculation valve wherein the Cv can be readily changed through the installation of different size spiral rings on the check valve disc.

It is an additional object of the present invention to provide a recirculation valve mechanism capable of being preset to allow given recirculation flow rates by presetting the position of the cylindrical bushings within the valve.

Another object is to provide multiple bypass inlet paths to provide greater bypass flow capacity for the same size bypass valve stem. A further advantage of this construction is that the upper bypass inlet ports provide another flow path through the valve stem when the valve is open providing increased main flow capacity.

These and other objects of the present invention and the various features and details thereof are hereinafter set forth in the following detailed description of the invention.

SUMMARY OF THE INVENTION

In accordance with the present invention a low-pressure recirculation valve for cooling a centrifugal pump is disclosed. The invention comprises a valve casing divided into inlet and outlet chambers. The casing has an inlet port for introducing fluids from a centrifugal pump into the inlet chamber and an outlet port for expelling fluids out of the casing through the outlet chamber. A check valve having a hollow valve stem separates the inlet and outlet chambers. The cylindrical hollow valve stem has a recirculation port for redirecting fluid from the hollow cylindrical valve stem to the pump. The check valve opens to permit flow from the inlet chamber to the outlet chamber and closes when no fluid flow exists. A spring biases the check valve towards a closed position. Finally, a recirculation valve formed as part of the valve stem opens the recirculation port when the check valve is closed and closes the recirculation means when the check valve is open. A two angle control surface between the check valve disc and the valve casing provides for a more linear relationship between the open position of the check valve and the flow.

BRIEF DESCRIPTION OF THE DRAWINGS

The foregoing summary, as well as the following detailed description, will be better understood when read in conjunction with the figures appended hereto. For the purpose of illustrating the invention, there is shown in the drawings an embodiment which is presently preferred, it being understood, however, that this invention is not limited to the precise arrangement and instrumentalities shown.

FIG. 2 is an enlarged sectional view of the two angle control surface, a portion of the check valve, and the seat embedded in the valve casing in the preferred embodiment, with the check valve in an open position.

FIG. 2*a* shows a modified form of valve seat which may be used with the present invention.

FIG. 3 is a sectional view of a modified bushing insert for the recirculation valve.

DETAILED DESCRIPTION OF THE INVENTION

Figure 1:
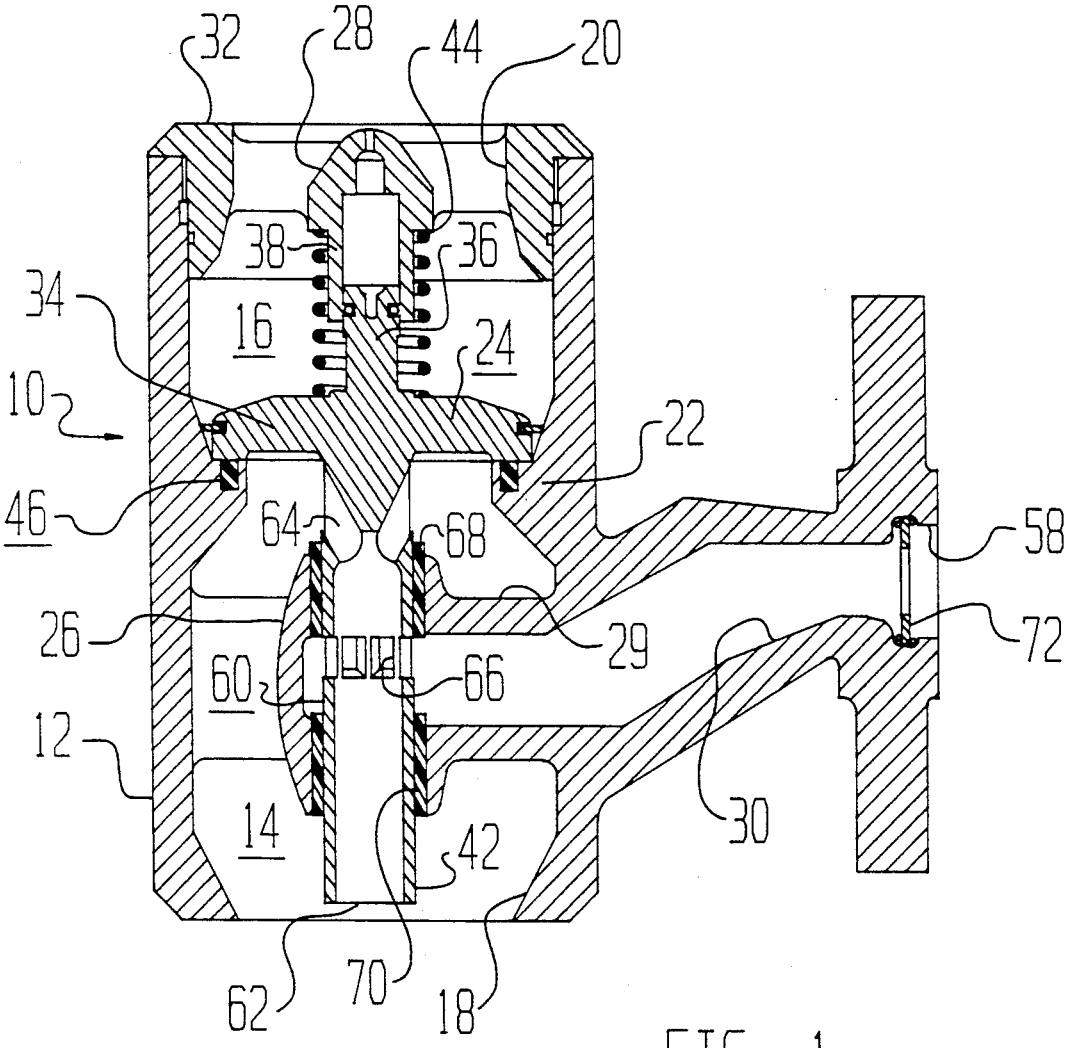
FIG. 1 is an elevated section view of one embodiment of a recirculation valve according to the present invention.

With reference to FIG. 1 there is illustrated a recirculation valve 10 made in accordance with the present invention. The recirculation valve 10 comprises a valve body 12 having inlet and outlet chambers 14 and 16 communicating, respectively, with inlet port 18 and outlet port 20. The recirculation valve is preferably constructed from a corrosion-resistant material such as cast iron or stainless steel. The inlet chamber 14 and outlet chamber 16 are separated by an inwardly directed annular rib 22 forming a valve seat for a check valve 24. The check valve 24 is mounted longitudinally of the valve body 12 and is guided in such movement by a lower boss 26 and an upper boss 28. The lower boss 26 is formed integrally with the valve body 12 and communicates with a valve stem guide 29 containing a recirculation passage 30, more fully described hereafter. The upper boss 28 is carried by a guide ring 32 secured to the upper end of the valve body 12 at the outlet port 20.

The check valve comprises a circular disc 34, a guide shaft 36 which is retained in position by an upper guide bushing 38 centered within the upper boss 28, and a hollow cylindrical valve stem 42 guided by the lower boss 26 and valve stem guide 29. The check valve 24 further incorporates a coiled biasing spring 44 between the upper guide bushing 38 and the check valve disc 34. The coil spring 44 provides spring-loaded activation of the check valve 24 between fully open and closed positions and biases the check valve 24 toward the closed position. While in the fully closed position, the check valve disc 34 rests against a valve seat insert 46 embedded in the annular rib 22 which extends from the walls of the valve body 12. This valve seat insert is used when the valve body is cast iron and may be a preformed ring of twenty-five percent glass filled teflon. The insert is not required in a stainless steel valve body. The valve seat 46 and disc 34 provide a seal when the check valve disc 34 is closed, preventing fluid flow from the outlet chamber 16 to the inlet chamber 14. The valve seat face 48 which comes in contact with the check valve disc 34 is at a two degree angle relative to the corresponding check valve disc face 50. This angle provides a uniform point of contact between the valve seat 46 and the check valve disc 34 around the entire circumference of the check valve disc 34, improving the seating of the check valve 24 when closed. The relation between the valve seat 46 and the check valve disc 34 is illustrated in FIG. 2, showing the check valve 24 in an open position. Other angles can be used depending on the resilience of the seat material. FIG. 2*a* illustrates another form of valve seat insert 46A and seating surface 48A which contacts the check valve disc in the closed position. In this the valve seat insert is chamfered in an inverted V shape with each chamfered surface being at preferably a three degree angle to the horizontal.

FIG. 2 shows a two angle control surface in the outlet chamber 16 defining a two section gap between the valve body 12 and the check valve 24 comprising a substantially perpendicular surface 52 abutting a second, angled surface 54. The first surface 52 defines a non-angled gap between the valve body 12 and the check valve disc 34. The non-angled gap provides for immediate lifting of the check valve from the seat upon initial flow. Thereafter, the angle of the second surface controls the lift of the disc with increased flow. This surface 54 includes a first relatively small shallow angled portion **54*a* and a second steeper angled portion 54*b*. As the downstream demand increases, correspondingly the rate of flow of fluid past the check valve increases. The angled gap, by virtue of its dual angled portions, permits a more uniform or straight line relationship of lift of the disc 34 as the flow rate increases. Alternatively, there may be a slight radius, not shown, in place of the shallow portion 54*a* to provide more uniform movement of the check valve disc. Another alternative is to replace both angles by a single radius R such as shown in broken lines in FIG. 2. The size of the angled gap can be preset and altered as required by installation of a circular ring 56 around the check valve disc 34. The size of the ring 56 limits the area of the gap between the valve housing and disc through which fluid can flow and thus controls the Cv of the valve 10**.

The recirculation passage 30 shown in FIGS. 1 and 3 leads from the inlet chamber 14 to the recirculation port 58. The valve stem 42 is hollow and includes valve stem inlet ports 62 and 64, and a plurality of outlet apertures 66. When the check valve is seated, fluid may flow through the valve stem and out of the apertures 66 into the recirculation passage 30. The valve stem guide as shown in FIG. 1 contains cylindrical upper and lower stem bushings 68 and 70 press fitted into the lower boss which engage the valve stem 42. The lower end of the upper stem bushing 68 determine the opening and closing of the apertures through which fluid exits the valve stem 42 and flows into the recirculation passage 30 relative to the position of the valve stem. The recirculation port 58 contains an orifice ring 72 which is interchangeable, the diameter of the opening provided controlling the Cv of the recirculation flow.

FIG. 3 illustrates a modified form of bushing inserts 74 and 76 which are positioned within the upper and lower boss and then distorted by pressure into annular recesses 78, 78 in the boss and locked in position.

Operation

Fluid emerging from the centrifugal pump enters the recirculation valve 10 through inlet port 18 causing the inlet chamber 14 and valve stem 42 to fill with fluid. During intervals of low downstream demand, fluid pressure in inlet chamber 14 approaches that of outlet chamber 20, causing the check valve 24 to be retained in a closed position by the spring 44. As a result, the fluid entering the valve 10 is redirected through the stem inlet port 62 into the valve stem and then through the bypass element 60. With the check valve 24 closed, the apertures 66 in the valve stem 42 are aligned with the opening to the recirculation passage 30, thereby permitting fluid flow through the bypass 60.

Upon demand downstream of the valve 10, a pressure differential between inlet chamber 14 and outlet chamber 16 is formed wherein the inlet chamber 14 fluid pressure becomes greater than that of outlet chamber 16. When the pressure differential exceeds the preload from the spring 44, the check valve 24 moves in a longitudinal direction toward its fully open position. The longitudinal movement of the check valve 24 towards the fully open position causes the valve stem to move, raising the apertures 66 out of their aligned position with the recirculation passage 30, reducing and eventually eliminating the Fluid now entering the valve stem 42 instead exits through valve stem outlet ports 64 and flows past the check valve disc 34 along with fluid flowing around valve stem 42 directly through inlet chamber 14 and past check valve 34. the valve stem 42 instead exits through valve stem outlet ports 63 and flows past the check valve disc 34.

The opening of the check valve 24 results in dislodging the check valve disc 34 from the valve seat 46 thereby breaking the seal between them and allowing fluid flow through outlet chamber 16 to outlet port 20. During initial flow of fluid, the check valve 24 moves to the top of the perpendicular surface 52 in the non-angled gap. As flow demand increases, the check valve 24 continues to move towards a fully open position. The rate of lift of the check valve is controlled by the angled surface 54 and the angled gap between the surface 54 and the check valve, providing a linear relationship between flow rate and the check valve disc movement.

When downstream demand reduces, fluid pressure in the outlet chamber 16 again builds up, reducing the pressure differential between it and the inlet chamber 14. When the force of the pressure differential becomes less than that of the force created by the spring 44, the spring 44 returns the check valve 24 to its fully closed position, again sealing the valve disc 34 against the valve seat 46. The valve stem apertures 66 are realigned with the recirculation passage 30, and fluid is again directed through the valve stem 42 into the bypass 60 to be recirculated back through the centrifugal pump.

It will be recognized by those skilled in the art that changes may be made to the above-described embodiments of the invention without departing from the broad inventive concepts thereof. It is understood, therefore, that this invention is not limited to the particular embodiment discloses, but is intended to cover all modifications which are within the scope and spirit of the invention as defined by the appended claims.

What is claimed is:

1. A recirculating valve for recirculating cooling water to a centrifugal pump comprising:

a valve casing having a first chamber for connection to a centrifugal pumping means, a second chamber for connection to a fluid outlet, a first port for introducing fluids from said centrifugal pump into said first chamber, a second port for expelling fluids out of said casing through said second chamber, and a recirculation port for redirecting fluid from said first chamber to said centrifugal pump;

means for changing the Cv within said valve;

check valve means situated between said first and second chamber, said check valve means comprising a substantially circular disc, said check valve means opening when the fluid pressure in said first chamber exceeds the fluid pressure in said second chamber and closing when the fluid pressure in said second chamber approaches that in said first chamber;

means for controlling the rate of flow of fluid through said recirculation port;

a slidable hollow valve stem coupled to said check valve means and extending through said first chamber, said valve stem moving responsively with said check valve means between open and closed positions;

a multiple angle control surface between the circular disc of said check valve and said valve casing for controlling the position and lift of said check valve relative to the flow of fluid past said check valve; and recirculation valve means operatively coupled to said check valve means for controlling the flow of fluid from said first chamber through said recirculation port, said recirculation valve impending such flow when said check valve means is open and permitting such flow when said check valve means is closed.

2. The recirculation valve of claim 1 further comprising means for biasing said check valve means toward the closed position.

3. The recirculation valve of claim 2 wherein said biasing means comprises a coil spring.

4. The recirculation valve of claim 1 wherein said multiple angle control surface comprises a two angle control surface in said valve casing in said second chamber.

5. The recirculation valve of claim 4 wherein said two angle control surface comprises a non-angled gap and an angled gap between said check valve disc and said valve casing in said second chamber, said angled gap having a first portion forming a first angle with said non-angled gap and a second portion forming a second angle with said non-angled gap of steeper extent than said first angle.

6. The recirculation valve of claim 1 wherein said multiple angle control surface comprises a radius in said valve casing in said second chamber.

7. The recirculation valve of claim 6 wherein said radius is situated in said valve casing such that the rate of change of the gap between said check valve circular disc and said valve casing is greater per increment of movement of the circular disc at the least open check valve position, and least per increment of circular disc movement at the most open check valve position.

8. The recirculation valve of claim 1 wherein said check valve means is retained in position by a fastening means.

9. The recirculation valve of claim 1 wherein said check valve disc rests against a seat embedded in said valve casing when in the closed position, said seat containing means for improved seating.

10. The recirculation valve of claim 9 wherein said improved seating means comprises a face of said seat which contacts said check valve disc being at a two degree angle relative to a corresponding face of said check valve disc.

11. The recirculation valve of claim 1 wherein said means for changing the Cv of the fluid within said recirculation valve comprises an interchangeable spiral ring embedded in said check valve disc.

12. The recirculation valve of claim 11 wherein said spiral ring controls the width of said angled gap.

13. The recirculation valve of claim 1 wherein said means for controlling the rate of flow of fluid directed through said recirculation port comprises cylindrical bushings situated between said valve casing and said valve stem.

14. The recirculation valve of claim 12 wherein said means for controlling the rate of flow of fluid further comprises variable positioning of said cylindrical bushing controlling the location or size of a gap between said bushings.

15. The recirculation valve of claim 1 wherein the means for controlling the rate of flow of fluid directed through said recirculation port further comprises an adjustable orifice plate mounted at said recirculation port.

16. The recirculation valve of claim 1 wherein said valve stem includes a plurality of apertures which permit fluid to flow from said first chamber through said recirculation port.

17. The recirculation valve of claim 15 wherein said structural means for controlling the position and lift of said check valve comprises a two angle control surface, being a nonangled gap and an angled gap between said check valve disc and said valve casing.

18. The recirculation valve of claim 17 wherein said means for charging the Cv of the fluid within said recirculation valve comprises an interchangeable spiral ring embedded in said check valve disc, permitting changes in the width of said angled gap.

19. The recirculation valve of claim 18 wherein said check valve disc rests against a seat embedded in said valve casing when in the closed position, said seat providing improved seating means, said seating means comprising a face of said seat, said face contacting said check valve disc, being at a two degree angle relative to a corresponding face of said check valve disc.

20. The recirculation valve of claim 1 wherein said valve stem includes a plurality of slots which align with said apertures to create a passageway for fluid when said check valve means is closed.

21. The recirculation valve of claim 1 wherein said multiple angle control surface comprises at least two angled control surfaces, wherein the angle of each successive control surface relative to the disc increases such that the rate of change of the gap between said check valve circular disc and said valve casing is greater per increment of circular disc movement at the least open check valve position, and lesser per increment of circular disc movement at the most open check valve position.

* * * * *

UNITED STATES PATENT AND TRADEMARK OFFICE

CERTIFICATE OF CORRECTION

PATENT NO. : 5,172,716

DATED : Dec. 22, 1992

INVENTOR(S) : George J. Paptzun

It is certified that error appears in the above-identified patent and that said Letters Patent is hereby corrected as shown below:

Col. 4, line 68: After "eliminating the" insert --flow of fluid through the bypass element 60.--

Col. 5, line 4: After "valve 34." delete --the valve stem 42 instead exits through valve stem outlet ports 63 and flows past the check valve disc 34.--

Signed and Sealed this

Twenty-sixth Day of October, 1993

Bruce Lehman

*Attest:*

BRUCE LEHMAN

*Attesting Officer*

*Commissioner of Patents and Trademarks*